US010181259B2

(12) United States Patent
Paulson

(10) Patent No.: US 10,181,259 B2
(45) **Date of Patent: *Jan. 15, 2019**

(54) METHOD AND APPARATUS FOR CREATING SECURITY AND CONTROL SYSTEM TRACKING IMMUNITY

(71) Applicant: Nortek Security & Control LLC, Carlsbad, CA (US)

(72) Inventor: Duane Ray Paulson, Carlsbad, CA (US)

(73) Assignee: Nortek Security & Control LLC, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/836,069

(22) Filed: Dec. 8, 2017

(65) Prior Publication Data

US 2018/0174433 A1 Jun. 21, 2018

Related U.S. Application Data

(63) Continuation of application No. 15/227,627, filed on Aug. 3, 2016, now Pat. No. 9,842,488.

(60) Provisional application No. 62/201,760, filed on Aug. 6, 2015.

(51) Int. Cl.
*G08B 29/18* (2006.01)
*G08B 25/00* (2006.01)

(52) U.S. Cl.
CPC ..... *G08B 29/185* (2013.01); *G08B 25/008* (2013.01)

(58) Field of Classification Search
CPC ..... G08B 29/185; G08B 25/008
See application file for complete search history.

(56) References Cited

U.S. PATENT DOCUMENTS

| | | | | |
|---|---|---|---|---|
| 5,565,844 | A | 10/1996 | Bedrosian | |
| 5,670,943 | A | 9/1997 | DiPoala et al. | |
| 7,411,489 | B1 | 8/2008 | Elwell et al. | |
| 8,115,641 | B1 | 2/2012 | Dempsey | |
| 9,842,488 | B2 * | 12/2017 | Paulson | G08B 25/008 |
| 2002/0133716 | A1 | 8/2002 | Harif | |
| 2004/0100386 | A1 | 5/2004 | Tendler | |
| 2004/0119819 | A1 | 6/2004 | Aggarwal et al. | |
| 2005/0031353 | A1 | 2/2005 | Ishii et al. | |
| 2005/0128067 | A1 | 6/2005 | Zakrewski | |

(Continued)

OTHER PUBLICATIONS

"U.S. Appl. No. 15/227,627, Non Final Office Action dated Apr. 19, 2017", 10 pgs.

(Continued)

*Primary Examiner* — Leon Flores
(74) *Attorney, Agent, or Firm* — Schwegman Lundberg & Woessner, P.A.

(57) ABSTRACT

Systems and methods grant immunity from a monitoring system. For example, a monitoring system comprises a portable device configured to communicate a unique identifier with a registration signal, and a monitoring system. The monitoring system comprises a database including the unique identifier, a sensor configured to detect a condition, and a controller configured to receive a detection signal from the sensor when the condition is detected. The monitoring system grants immunity from the sensor to the portable device when the registration signal is received by the monitoring system.

23 Claims, 8 Drawing Sheets

(56) References Cited

U.S. PATENT DOCUMENTS

| | | | |
|---|---|---|---|
| 2006/0022794 | A1 | 2/2006 | Determan et al. |
| 2012/0327241 | A1 | 12/2012 | Howe |
| 2014/0218195 | A1 | 8/2014 | Buckley |
| 2016/0189529 | A1 | 6/2016 | Lee et al. |
| 2017/0039843 | A1 | 2/2017 | Paulson |

OTHER PUBLICATIONS

"U.S. Appl. No. 15/227,627, Notice of Allowance dated Aug. 24, 2017", 11 pgs.
"U.S. Appl. No. 15/227,627, Response to Non Final Office Action dated Apr. 19, 2017", 12 pgs.

* cited by examiner

METHOD AND APPARATUS FOR CREATING SECURITY AND CONTROL SYSTEM TRACKING IMMUNITY

CLAIM OF PRIORITY

This Application is a continuation of U.S. patent application Ser. No. 15/227,627, filed on Aug. 3, 2016, which claims priority to U.S. Provisional Patent Application Ser. No. 62/201,760, filed on Aug. 6, 2015, which are hereby incorporated by reference in their entirety.

TECHNICAL FIELD

The present disclosure is directed generally to security systems, monitoring systems, surveillance systems, access control systems, automation systems, emergency response systems, and control systems for use in home, commercial and government environments, and the like, which may be configured to interact with the Internet of Things. More particularly, the present disclosure relates to credentials and tracking devices for use with such systems.

BACKGROUND

The use of networked electronics has increased in all areas of home and work life. For example, the popularity and ubiquity of smartphones and application usage has exploded over the last decade, in part fed by the increase in broadband and streaming usage. Wearable devices, in the form of smartwatches, activity trackers, proximity tags, etc. have recently been gaining in popularity, with multiple manufacturers establishing communication links between the smartwatches and corresponding smartphones. Other areas such as home and work automation, security and telematics systems have benefited from the use of connected devices and led to the promise of the Internet of Things. With the rise of such automation, security and telematics systems, there also is a need for establishing physical security within those systems.

Typical security systems rely on programmable keys or cards to gain access to secure areas. These systems, however, are passive in that they do not provide any information pertaining to individuals attempting to gain access that are not granted a security key or card. Other active systems incorporate sensors that provide information regardless of the presence of a security key or card. For example, motion sensors are configured to detect the presence of any movement in a monitored area. These systems are susceptible to false alarms, particularly from pets maintained within the monitored area. Various systems and methods have been developed to distinguish between different types of intruders or occupants. For example, one method involves determining an aspect ratio of a being within the monitored area using cameras. Another method involves detecting upper and lower zones with passive infra-red sensors and associated algorithms in the monitored area. Additionally, another method uses a pet collar including a tag that sends wireless instructions to the security system to turn down the sensitivity, e.g. the pulse count, of a passive infra-red motion sensor.

OVERVIEW

The inventor has recognized, among other things, that a problem to be solved in security and monitoring systems is the generation of false alarms by entities authorized to be in a secured area, such as a guard, a pet, a home owner or a caregiver. In an example, the present subject matter can provide a solution to this problem, such as by providing registered entities an immunity-granting wearable device that informs the security and monitoring system to ignore detection of entities associated with the wearable device.

The present disclosure is directed to systems and methods for granting immunity to a monitoring system. A system comprises a portable device configured to communicate a unique identifier with a registration signal, and a monitoring system. The monitoring system comprises a database including the unique identifier, a sensor configured to detect a condition, and a controller configured to receive a detection signal from the sensor when the condition is detected. The monitoring system grants immunity from the sensor to the portable device when the registration signal is received by the monitoring system. A method for granting immunity to an entity in a monitoring system comprises registering a unique identifier associated with a portable device with a monitoring system, detecting an entity associated with the portable device by a sensor, and withholding activation of an alarm based on registration of the registered portable device.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the figures and the drawings contained therein, which are not necessarily drawn to scale, like numerals may describe similar components in different views. Like numerals having different letter suffixes may represent different instances of similar components. The figures and drawings illustrate generally, by way of example, but not by way of limitation, various embodiments discussed in the present document.

DETAILED DESCRIPTION OF THE INVENTION

The following description and the figures and drawings sufficiently illustrate specific embodiments to enable those skilled in the art to practice them. Some embodiments may incorporate structural, logical, electrical, process, and other changes. Portions and features of some embodiments may be included in, or substituted for, those of some embodiments. Embodiments set forth in the claims encompass all available equivalents of those claims.

Figure 1:
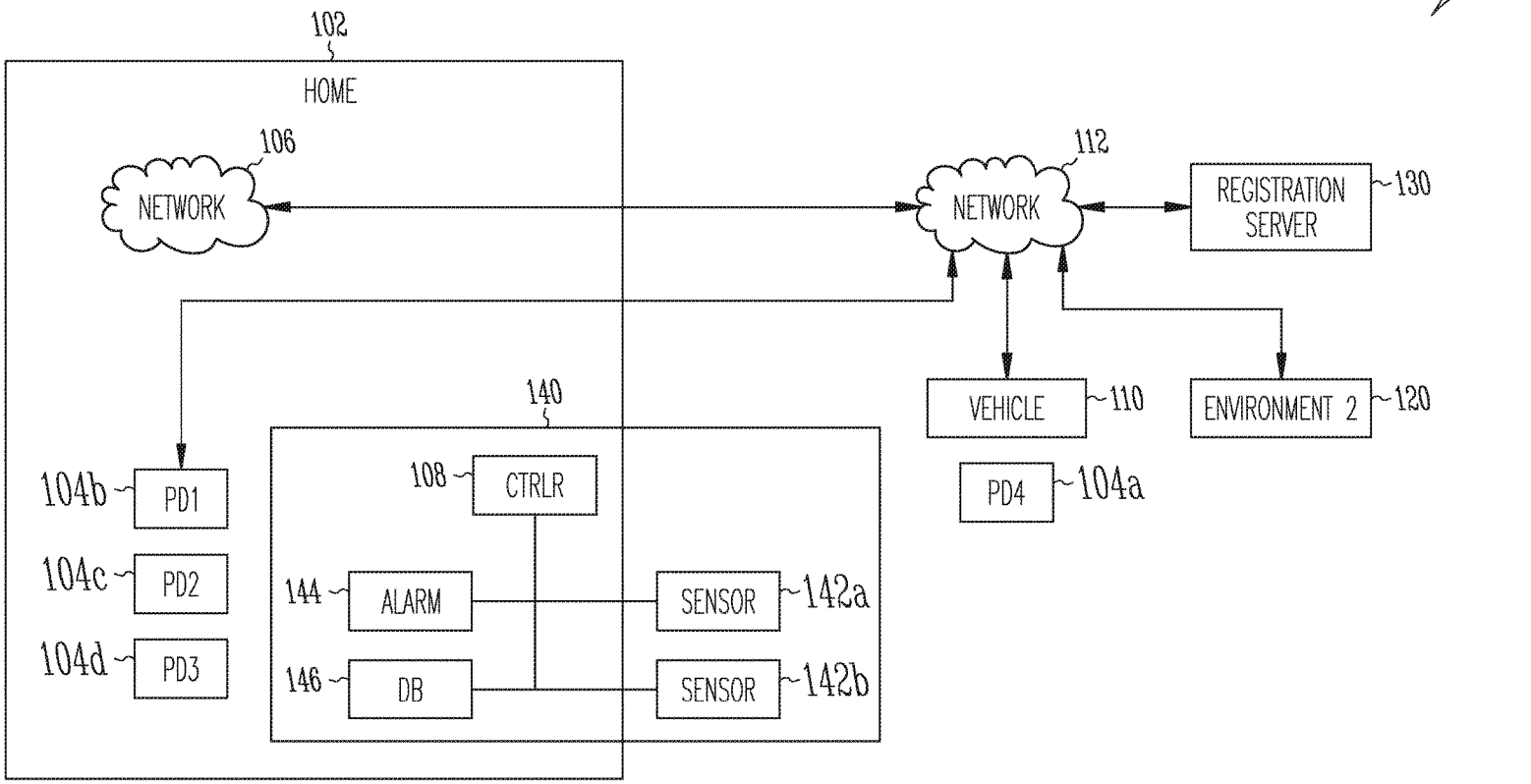
FIG. 1 illustrates a home automation system and a portable credential or tracking device in accordance with some embodiments of the present disclosure.

FIG. 1 illustrates a system in accordance with some embodiments. The system 100 may contain a plurality of environments including a home (residential) environment 102, a vehicle 110, and another environment 120. The other environment may be a work environment such as an office building, a different home environment, a commercial environment such as for example a bricks-and-mortar store that the connected individual is visiting, a school or other educational institution, for example. The various environments 102, 110, 120 may be connected by one or more networks 112. The network 112 may be an external network, such as the internet or a private network. Communications may use 3rd Generation Partnership Project (3GPP) telecommunication devices, systems and technologies. Other equipment, such as base stations, routers, access points, gateways and the like used in communicating through the network 112 are not shown for convenience. The transmission through the network 112 may be encrypted or clear. In some cases, the data may be communicated through the network 112 using a virtual private network or other tunneling mechanism.

System 100 further includes monitoring system 140, which includes sensor 142*a*, sensor 142*b*, alarm 144 and database 146. Monitoring system 140 may be configured to provide security, automation and control to home 102. System 140 is herein after referred to as a monitoring system, but may comprise any of a security system, a monitoring system, a surveillance system, an access control system, an automation system, an emergency response system, and a control system for use in home, commercial and government environments, or the like.

System 140 may include any number of sensors, but only two are shown for illustrative purposes. The sensors may comprise any type of sensor, such as motion detectors, door and window sensors, pressure sensors, shock detectors, photo beam sensors, temperature sensors, air quality sensors and the like. Each sensor can be configured to generate a detection signal upon detection of a condition, e.g. contact, pressure, temperature, motion or the like.

The home environment 102 may contain an internal network 106 through which various devices communicate using one or more of WiFi, Bluetooth, Zigbee, infrared (IR), near field communication (NFC), 3GPP or other technologies. The home environment 102 may contain multiple portable devices 104*a*, 104*h*, 104*c*, 104*d* as well as one or more localized devices and/or systems, such as controller 108, that remain in the home 102. Portable devices 104*a*-104*d* can be located within home environment 102 or outside of home environment 102. Each of portable devices 104*a*-104*d*, and any other devices configured for use with the system, can include a unique identifier that can be enrolled in database 146. Controller 108 may be controlled, as below, dependent on which one or more of the portable devices 104*a*, 104*b*, 104*c*, 104*d* is present. In another embodiment, controller 108 may comprise a controller that can also control other components of system 100, such as sensors 142*a* and 142*b* and other automated components of system 100, based on the presence of one or more of the portable devices 104*a*-104*d*. In particular, system 140 can be configured to grant immunity to the bearer of portable devices 104*a*-104*d* from one or more of sensors 142*a* and 142*b*, if the unique identifier is verified with database 146, thereby allowing the portable device and the bearer to be invisible to system 100 such that, for example, alarm 144 is not triggered. One or more of the portable devices 104*a*, 104*b*, 104*c*, 104*d* may be able to determine its location via global positioning system (GPS), assisted-GPS, localization through access point determination, or other localization techniques, as discussed in more detail below. The internal network 106 may have a hub such as a security panel, router, or dedicated access point for communication with one or more of the portable devices 104*a*, 104*b*, 104*c*, 104*d*.

The portable devices 104*a*, 104*b*, 104*c*, 104*d* may include wearable devices configured to be worn by individuals and attachable tags for pets and objects. The tags may be fabricated using a durable material and designed with an integrated opening allowing for the tag to be added to a key ring, a pet collar or other such device. Furthermore, the tag may be configured to include a tamper sensor that can transmit a signal to system 100 indicating that a shell or housing of the device has been compromised, e.g. opened. For example, the tag many include a pressure sensor that senses the contact from opposing walls of a clamshell structure. When the clamshell structure is opened, the tag receives a signal from the pressure sensor that can be conveyed to controller 108 to indicate the tag has been tampered with and that any security privileges registered to that tag should be revoked. A short strap with a fastener may be included with the tag to allow the user to attach it to the handle of an item. A variation of the tag may allow for attachment to the zipper of a jacket. Each portable device 104*a*, 104*b*, 104*c*, 104*d* may both provide information and receive (gather and use) the information, depending on the information and the circumstances. Portable devices 104*a*, 104*b*, 104*c*, 104*d* may include various sensors to gather information about the device or a wearer of the device. For example, portable devices 104*a*, 104*b*, 104*c* and 104*d* can include location sensors, such as a GPS chip, and motion sensors, such as a gyroscope or an accelerometer. The motion sensors can be activated upon movement of the portable device itself. Data relating to the motion or movement of the portable device can be stored in the device and/or transmitted to other systems or components via an appropriate electronic signal, as discussed below. The wearable devices may include smart watches, necklaces/lanyards, armbands/bracelets, leg bands, eyewear or clothing such as belts or smart clothing. For example, wearable bracelets and the tags may include an embedded Bluetooth Low Energy (BLE) sensor. The BLE sensor in the wearable bracelet is able to communicate with a dual universal serial bus (USB) cigarette lighter plug-in adaptor with rechargeable batteries and BLE radio that is configured to be placed in the vehicle 110.

A tag may be configured in a variety of form factors, such as a pendant, a watch, a wristband, a clip, a card or the like. A tag may be shaped and sized so as to be ergonomic and portable. A tag may have an integrated opening allowing for the tag to be added to a key ring, pet collar or other device, may have a short strap with a fastener to allow the user to attach the tag to the handle of an item and a low battery indicator along with an accelerometer to detect movement for the purpose of battery conservation. A wearable device or tag may contain a remotely programmable/adjustable algorithm allowing for wake-up, transmission and sleep frequency intervals based on various situations. For example, if no movement is detected, the wearable device or tag goes into a deep sleep but may need to be woken up (e.g., being paged). If movement is detected, the wearable device or tag wakes up and pings a predetermined number of times per minute. If the wearable device or tag picks up a BLE data reader, the ping increases to a higher rate of times per minute. If connectivity with a BLE data reader is lost, the wearable device or tag returns to the original predetermined number of times per minute check-in interval.

Controller 108 may include plug-in or battery-powered readers. The use of a plug-in reader that is compatible with multiple formats permits a wide range of freedom in using portable devices in the system. An affirmation feature—visual and/or audible—may be incorporated into the plug-in devices to signal proper connectivity with the network and each other, as well as indicating battery mode operation/low battery. Additional plug-in devices may, on occasion, be added to an environment at a later date and/or plug-in devices may be removed, re-installed or re-positioned. Generally speaking, once installed, the plug-in devices are not expected to be removed or manipulated under normal circumstances. In one embodiment, controller 108 may comprise a controller for a security system such as, for example, monitoring system 140 including sensors 142*a* and 142*b*. Controller 108 can therefore be part of monitoring system 140. As such, controller 108, alarm 144, sensors 142*a* and 142*b*, and database 146 can communicate with each other, directly or by way of other components, in various examples. Thus, database 146, which may comprise data programmed into a tangible storage medium, may reside as a separate component from controller 108 and sensors 142*a*, 142*b*, or may reside as a component within controller 108 and sensors 142*a*, 142*b*.

The portable devices 104*a*, 104*b*, 104*c*, 104*d* may be configured to communicate with the plug-in readers through Z-Wave, ZigBee, and/or Wi-Fi radios in addition to or instead of Bluetooth. The plug-in readers may have two-way voice functionality, again via BLE, Wi-Fi or ZigBee for example. The use of two-way voice functionality may allow for communication to occur from any room in the home 102 with, for example, a remotely-located central monitoring station of a PERS service. Plug-in readers without two-way voice functionality may be used as access points for data capture from the portable devices 104*a*, 104*b*, 104*c*, 104*d*. Each portable device 104*a*, 104*b*, 104*c*, 104*d* may include an identification that is used to interact with the environment and may be used to control the portable device 104*a*, 104*b*, 104*c*, 104*d*. The portable device 104*a*, 104*h*, 104*c*, 104*d* may operate in any of the environments as personalized triggers for programmed events and actions to occur with legacy security, access control, home automation, heating, ventilating, and air conditioning (HVAC), personal emergency response systems (PERS) solutions, and irrigation control. As mentioned, portable devices 104*a*-104*d* may be granted immunity from the actions of sensors 142*a* and 142*b* such that controller 108 will not activate alarm 144, depending on the registration of a unique identifier with database 146 for each particular device.

In some embodiments, a user may register one or more of the information providers of the portable devices 104*a*, 104*h*, 104*c*, 104*d* through the network 112 with a registration server 130. The registration server 130 may be a dedicated server or a distributed server/cloud-based storage system such that information providers (as well as the information receivers) of the portable devices 104*a*, 104*b*, 104*c*, 104*d* are registered through cloud-based software. The registration server 130 may contain information including, for example, that related to the identification of the portable devices 104*a*, 104*b*, 104*c*, 104*d*, a schedule of a particular individual, animal, or object associated with the portable device 104*a*, 104*b*, 104*c*, 104*d* (as well as possibly the association itself), and an assignment of events and actions for the portable devices 104*a*, 104*h*, 104*c*, 104*d* when in particular locations. The events and actions may include notifications to others of the portable device 104*a*, 104*b*, 104*c*, 104*d*, or individuals through other mechanisms that are not part of the system (e.g., a laptop computer or automated telephone call to a work phone). The identification of portable devices 104*a*-104*d* may include logging of a unique identifier for each of portable devices 104*a*-104*d* in database 146. For example, each of portable devices 104*a*-104*d* can be registered with controller 108 by using registration server 130 or by direct registration with each of sensors 142*a* and 142*b*.

The registration server 130 may also permit queries from registered devices or individuals regarding the status of individual portable devices 104*a*, 104*b*, 104*c*, 104*d* (e.g., whether a particular portable device has arrived at a predetermined location, the time of arrival, whether other registered devices have accompanied the particular portable device, etc.). The individuals or devices may be registered at any point prior to responding to the query such that only registered individuals or devices are able to obtain the desired information from the registration server 130. The registration server 130 may also permit access to only certain information, depending on limitations set by the registered owner of the system. For example, some individuals or devices may only be able to obtain information as to whether a particular portable devices 104*a*, 104*b*, 104*c*, 104*d* has arrived at a destination, while others may be able to obtain the time of arrival and manner of arrive (e.g., from which registered vehicle or other conveyance). The registration server 130 may respond to any query containing a correct password, set by the system owner, for the portable devices 104*a*, 104*b*, 104*c*, 104*d* without using a previous registration.

The portable devices 104*a*, 104*b*, 104*c*, 104*d* may communicate directly with, or control via registration server 130 (i.e., indirectly control), controller 108. Note that although controller 108 is shown as being disposed in only the home 102, they may be in other environments, such as the vehicle 110 or the second environment 120. The localized devices and/or systems 108 may include, for example, devices and systems such as indoor and outdoor lighting, HVAC, music or seating positions. Specialized devices and systems, such as motorized dampers for personalized HVAC temperature control, pressure pads in a non-removable car seat (for car security for young children), and outdoor sensors to extend the security zone for pets, wandering kids/seniors and car security, may also be used. In one embodiment, controller 108 may comprise a controller for monitoring system 140 that includes sensors 142*a* and 142*b*, which can be configured as motion and contact sensors, respectively.

In some embodiments, the plug-in readers may be installed in electrical wall sockets near common entrances and exits within the home 102. The plug-in readers may also be installed on different floors or areas in the home 102 such as the upstairs, basement, and garage. The plug-in readers may, as above, have a unique identification and be used to signal the registration server 130 when in communication with the portable devices 104*a*, 104*b*, 104*c*, 104*d*. The plug-in readers may be used to activate various mechanisms of controller 108. As above, the plug-in readers may be used in the vehicle 110 and the second environment 120.

In operation, a primary user or system owner may access software to assign each of the portable devices 104*a*, 104*b*, 104*c*, 104*d* to the members of a household and tags to what the user deems as important items (possessions or pets) and that are transported in and out of the house 102 as part of the household's daily or weekly routine. The software may be stored in tangible memory in one of the portable devices 104*a*, 104*b*, 104*c*, 104*d* or in an entirely different device, such as a laptop computer. Individual and group preferences and related actions, schedules of the individuals and reminders may be stored for some or all of the portable devices 104*a*, 104*b*, 104*c*, 104*d*. In one particular embodiment, the user may store this and other information regarding a wearable sensor and/or a tag assigned to different individuals or items.

In one example implementation, a plug-in reader in the particular environment (e.g., home, vehicle) recognizes one or more tags and interfaces with a cloud-based system via the hub to determine the appropriate action. In another example implementation, sensors 142*a* and 142*b* in the particular environment (e.g., home, vehicle) recognizes one or more tags and interfaces with controller 108 to determine the appropriate action, such as whether or not to activate alarm 144. The appropriate pre-programmed action may be based on timing and/or combination of portable devices present. The timing may include the day of the week, the time of day, season, or month. The combination of portable devices may include the presence or absence of a specific user, a specific tag or a specific combination of users or tags. For example, a vehicle detecting multiple tags may act differently than if only one tag is detected, with specific examples provided below. In further embodiments, one or more of the portable devices may contain sensors such as accelerometers, gyroscopes, bodily monitors (e.g. heartrate or blood pressure monitor). Measurements taken by such sensors may in addition be provided to the plug-in reader or other device and may be used to determine the appropriate action.

Figure 2:
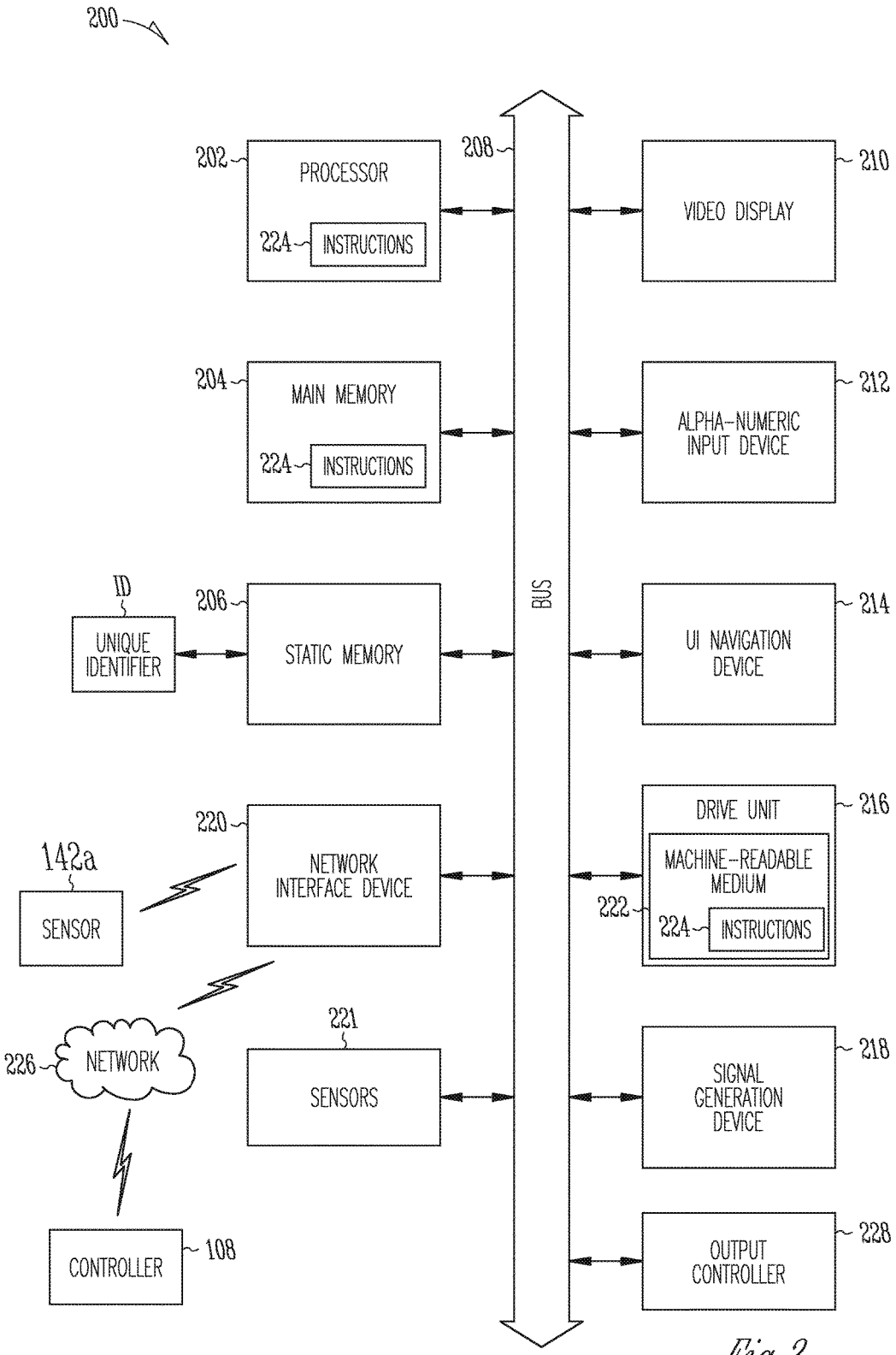
FIG. 2 illustrates a portable credential or tracking device of FIG. 1 having a unique identifier in accordance with some embodiments of the present disclosure.

FIG. 2 illustrates a block diagram of a portable device in accordance with some embodiments. The portable device may or may not contain all of the modules described herein. In some embodiments the machine may be a computer configured to perform any one or more of the techniques discussed herein. As indicated above, the portable device 200 may be a laptop computer, a tablet PC, a personal digital assistant (PDA), a mobile telephone, a smart phone, a tag, or any machine capable of executing instructions (sequential or otherwise) that specify actions to be taken by that machine.

Examples, as described herein, may include, or may operate on, logic or a number of components, modules, or mechanisms. Modules and components are tangible entities (e.g., hardware) capable of performing specified operations and may be configured or arranged in a certain manner. In an example, circuits may be arranged (e.g., internally or with respect to external entities such as other circuits) in a specified manner as a module. In an example, one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" (and "component") is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

Portable device 200 may include a hardware processor 202 (e.g., a central processing unit (CPU), a GPU, a hardware processor core, or any combination thereof), a main memory 204 and a static memory 206, some or all of which may communicate with each other via an interlink (e.g., bus) 208. Although not shown, the main memory 204 may contain any or all of removable storage and non-removable storage, volatile memory or non-volatile memory. The portable device 200 may further include a display unit 210, an alphanumeric input device 212 (e.g., a keyboard), and a user interface (UI) navigation device 214 (e.g., a mouse). In an example, the display unit 210, input device 212 and UI navigation device 214 may be a touch screen display. The portable device 200 may additionally include a storage device (e.g., drive unit) 216, a signal generation device 218 (e.g., a speaker), a network interface device 220, and one or more sensors 221, such as a global positioning system (GPS) sensor, compass, accelerometer, pressure sensor, tamper sensor, or other sensor. The portable device 200 may include an output controller 228, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 216 may include a machine readable medium 222 on which is stored one or more sets of data structures or instructions 224 (e.g., software) embodying or utilized by any one or more of the techniques or functions described herein, as well as the unique identifier for each device. The instructions 224 and the unique identifier may also reside, completely or at least partially, within the main memory 204, within static memory 206, or within the hardware processor 202 during execution thereof by the portable device 200. In an example, one or any combination of the hardware processor 202, the main memory 204, the static memory 206, or the storage device 216 may constitute machine readable media.

While the machine readable medium 222 is illustrated as a single medium, the term "machine readable medium" may include a single medium or multiple media (e.g., a centralized or distributed database, and/or associated caches and servers) configured to store the one or more instructions 224. The term "machine readable medium" may include any medium that is capable of storing, encoding, or carrying instructions for execution by the portable device 200 and that cause the portable device 200 to perform any one or more of the techniques of the present disclosure, or that is capable of storing, encoding or carrying data structures used by or associated with such instructions. Non-limiting machine readable medium examples may include solid-state memories, and optical and magnetic media. Specific examples of machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; Random Access Memory (RAM); and CD-ROM and DVD-ROM disks. In some examples, machine readable media may include non-transitory machine readable media. In some examples, machine readable media may include machine readable media that is not a transitory propagating signal.

The instructions 224 may further be transmitted or received over a communications network 226 using a transmission medium via the network interface device 220 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi IEEE 802.16 family of standards known as WiMax®), IEEE 802.15.4 family of standards, a Long Term Evolution (LTE) family of standards, a. Universal Mobile Telecommunications System (UMTS) family of standards, peer-to-peer (P2P) networks, among others. In an example, the network interface device 220 may include one or more physical jacks (e.g., Ethernet, coaxial, or phone jacks) or one or more antennas to connect to the communications network 226. In one embodiment, network interface device 220 can be configured to communicate directly with sensors 142*a* and 142*b*, and network 226 can be configured to communicate with controller 108, in order for each to receive the unique identifiers from each portable device 104*a*-104*d*. In other embodiments, network interface device 220 can be configured to communicate directly with controller 108, and network 226 can be configured to communicate with registration server 130.

Figure 3:
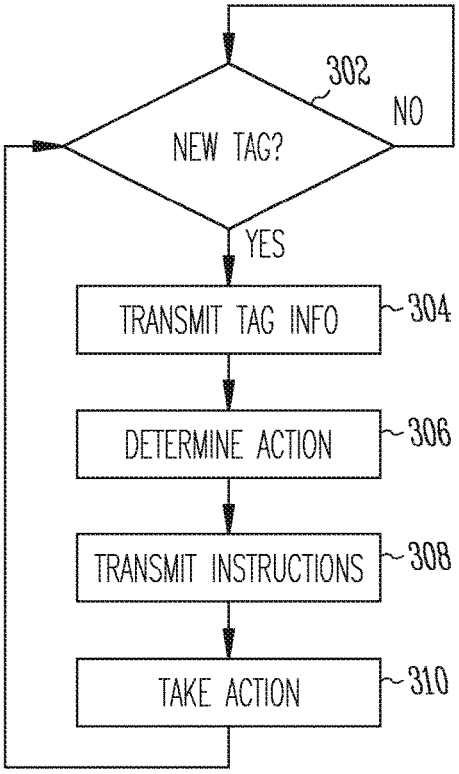
FIG. 3 illustrates a flowchart of a method of using a portable device in accordance with some embodiments of the present disclosure.

FIG. 3 illustrates a flowchart of a method of using a personal device in accordance with some embodiments. The plug-in reader (or controller 108 or sensors 142*a* and 142*b*) determines at operation 302 whether information of a new tag has been received. When tag information has been received, at operation 304, the plug-in reader transmits the tag information, along with its own information and perhaps time, date and other relevant location to the server/cloud-based storage system. The server at operation 306 determines the appropriate action to take (such as by referencing database 146) due to the presence of the new tag in the location and at operation 308 transmits instructions to the plug-in reader or other connected device in the environment in which the tag is located. The server may also notify a desired set of individuals or devices of arrival of the tag at the location and/or actions taken in response to the arrival. At operation 310, the indicated actions are taken by the device(s) or system(s) in the local environment of the tag.

Some examples of the method of FIG. 3 are provided. Wearable devices are assigned to different individuals, tags are assigned to an infant but attached to a removable car seat, attached to a key chain of one of the individuals, a pet (and attached to the pet collar), gym bags, a lunchbox, an instrument case, a diaper bag, a professional caregiver of various ones of the individuals and recyclable grocery bags. System 100 and monitoring system 140 can be configured to execute various actions based on input from various sensors 142*a*, 142*b* and the presence of various tags or portable devices 104*a*-104*d*, such as controlling temperature in home 102, controlling lighting in home 102, controlling garage doors of home 102, monitoring traffic and access patterns of entities within home 102, controlling door and window locks, controlling motion sensors, and the like.

Regarding security, each personalized wearable device and/or tag may be configured to act as an electronic key to arm/disarm a security system (or a specific part of the security system) based on presence either as an independent, stand-alone solution or in conjunction with the presence of a recognized smart phone or other action such as an abbreviated arm/disarm sequence, or along with each wearable device or tag including a registered unique identifier. This may include arming the security system automatically when the last person leaves the home in the morning but automatically disarming it if a specific one of the individuals having a wearable device or tag comes to the main floor, e.g., to let the pet in or out, and rearming the system automatically when that same individual later passes by the plug-in sensor located in the specific dwelling area of the individual. Furthermore, with monitoring system 140, as opposed to disarming all of system 100, system 100 may remain armed, while signals from particular sensors may be muted by the individual sensor itself, or ignored by controller 108, if the unique identifier is verified with database 146. Similarly, the presence of multiple ones of the wearable devices and/or tags may trigger different arming or disarming of the security system, e.g., unlocking (or requiring a shortened access code) a particular door if only one wearable device is present but unlocking a different door or the particular door and another door if a combination of wearable devices and tags associated with different individuals are present.

In some embodiments, the system checks with, or is sent instructions periodically by, the server (which has a schedule or history of individual interaction) such that the home may expect a particular individual to arrive home at a particular time of day on specific days. In this case, the time/day may be used for security and home automation control such that the presence of a wearable or tag associated with the expected individual detected at or near the front door in this time frame may trigger the security system to automatically disarm the security system, or sub-portion(s) thereof, and/or set the climate inside the house (e.g., HVAC, turn up the water heater from idle). For added security, the system could be configured to require additional actions (i.e. key pad entry only) by the individual if the presence is detected at the front door at a different time of day (e.g., late at night or early in the morning).

In the case of activity monitoring, the system may generate an alert if an expected activity level or activity itself does not match a predetermined pattern. For example, no trip to (or excessive trips to) a restroom or kitchen within a predetermined amount of time may trigger an alert. The system may also be configured to generate either a local alai in or outbound text message/call if the individual leaves the home or, for example, tries to go to an unauthorized area. If the individual is elderly and a tag is given to a caregiver, the tag may log the caregiver's arrival and departure times, and the system may correspondingly grant access to all or a limited portion of the home to the caregiver. The limited areas may, of course, change at different time periods such that if the caregiver is present at an unauthorized time, no access may be provided to the caregiver unless an emergency situation is detected that overrides the system.

In circumstances in which the caregiver is not present, the system may detect whether the elderly individual has placed an associated smart phone in a charging cradle and a subsequent emergency event is detected by a PERS device or portable device while the smartphone is inaccessible to the elderly individual. The emergency alert may be routed by the system from a pendant-style PERS transmitter to the nearest plug-in reader or sensor to the smartphone, where an outbound communication occurs and a two-way voice communication is established with the central monitoring station (CMS) via the plug-in reader or sensor.

As above, the smartphone application may run on any operating system, such as Android or iOS. The application may provide a number of abilities. These abilities include the ability to generate an outbound alert in the event of the distance between the device and the phone reaches a predetermined threshold (e.g., more than about 10 feet (low RF signal), the ability to interact with the dual USB car cigarette lighter adaptor device and cloud based database of items, time and rules, the ability to auto-generate an audible alert, the ability for the user to cancel an audible alert, the ability for an alert cancellation by a user to be logged in the cloud based software, the ability to wireless connect and operate with wearable devices, tags and readers, the ability to select user generated identifiers that are configured to the system (i.e. garage door, HVAC, lights, etc.) and enter manual commands ("open/close", "on/off", "home/away", etc.), and the ability to receive low battery alerts and system operating status, among others.

The cloud based software may provide a user portal and permit the user to register the smartphones, wearable devices, tags and readers, schedule and/or assign events and actions, interface and manage legacy systems, notify others (e.g., send messages), query smartphones and plugins for status, modify check-in and sleep frequencies of wearable devices and tags based on user needs, provide manual system configuration as well as an automatic set-up wizard and provide a low battery warning indicator and identification of wearable devices and tags.

In some embodiments, a proximity based geo-fence/location system (non-GPS, non-WAN/triangulation, etc.) may permit tracking and connecting potentially multiple smartphones and BT/BLE wearable devices with other systems, sub-systems and wireless protocols (GPS, WAN, routers, mobile/fixed electronics, security panels, home automation, GDOs, etc.) to trigger pre-determined actions. The system may provide the ability to associate a smartphone or BT/BLE tag with a user and assign preferences and/or actions to occur in accordance with a list of eligible legacy systems, available options, time of day, day of the week, and presence status of other smart phones and/or tags. A centralized storage, application and manipulation of user preferences, presence status and associated actions may be provided for one or more users (tags, smart phones, etc.) with distributed inputs, outputs and various degrees of intelligence located throughout the connecting systems and sub-systems of the overall system. A single solution platform may allow for presence-based asset tracking, home automation and personalization triggers to occur in both fixed (home/commercial) and mobile (car/smart phone) environments. The system may provide the ability to modulate the data readers in order to customize the coverage area of a given wireless zone. In this case, the installation of more readers operating in lower power may provide a greater degree of, as an example, room-by-room actions to occur and a fewer number of readers operating with higher power may reduce the granularity of presence based triggers to, as an example, "home or away" or perhaps "upstairs or downstairs." The data readers may be able to operate as a mesh network. The modular data readers (data and voice and data readers) may have multiple radios allowing for wireless connectivity with various systems and sub-systems. The use of plug-in readers may result in easy installation (no wires) and a high degree of flexibility for coverage expansion or reduction. The use of a car cigarette lighter adaptor with rechargeable batteries and BLE radio (or USB connector dongle with identical functionality) may permit interaction with a smartphone and tags to create a system for presence and status in a vehicle (engine is on/off, active/sleep mode, smart phone-to-beacon distance vs. tag-to-beacon distance, etc.). The system may allow for a high degree of automation and personalization to occur and, as such, represents a significant step forward for the home automation market. The system may provide the ability to track people, pets and things to and from the home, vehicle and smart phone is an expansion on traditional wireless asset tracking systems.

Figure 4:
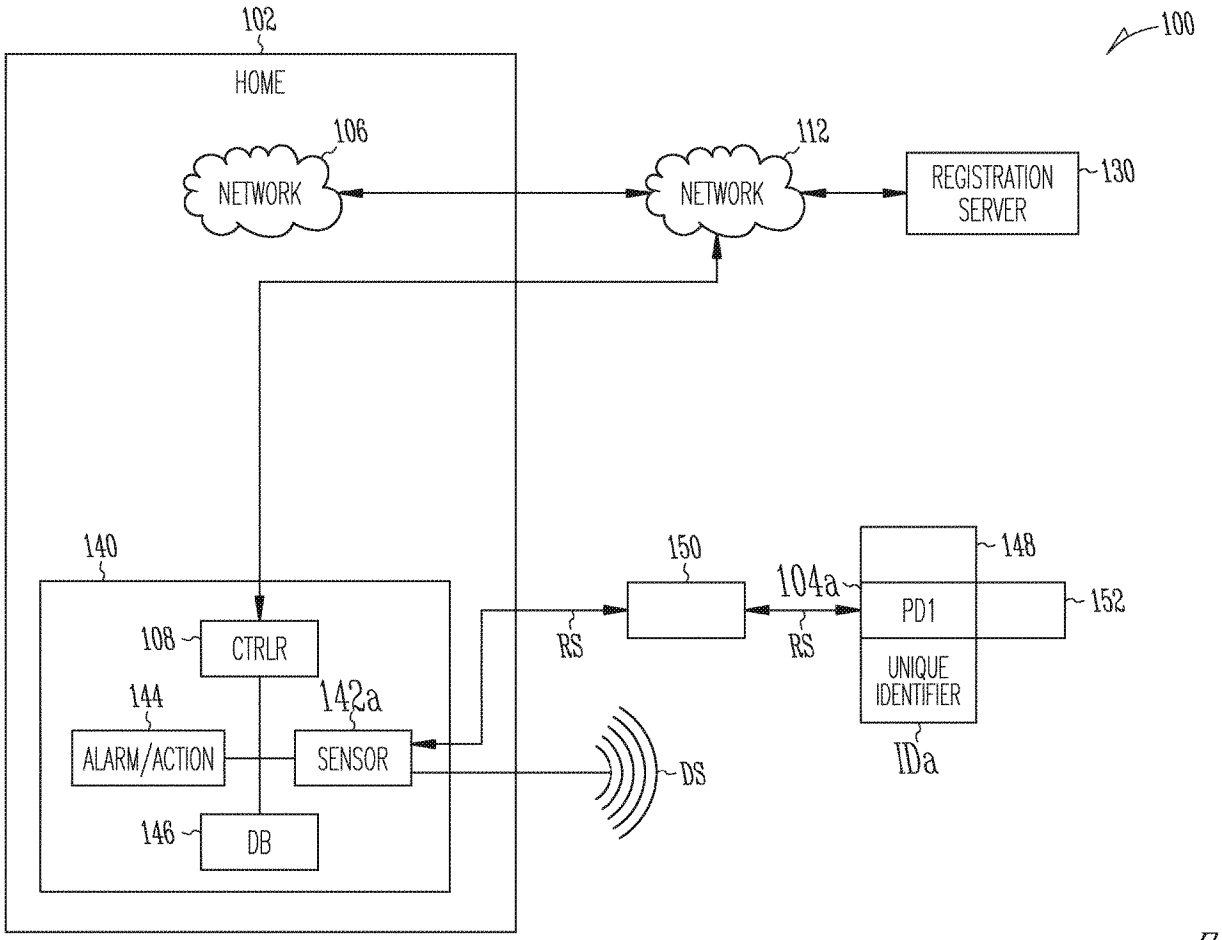
FIG. 4 illustrates the system of FIG. 1 including a monitoring system for interacting with a portable device having an immunity-granting unique identifier.

FIG. 4 illustrates a portion of system 100 of FIG. 1, including monitoring system 140 for interacting with portable device 104*a* having an immunity-granting unique identifier IDa. Portable device 104*a* is connected to or otherwise in close proximity to entity 148, which may comprise a person, animal, automobile, object or something else. Portable device 104*a* is configured to communicate with sensor 142*a* in the illustrated embodiment using registration signal RS. Additionally, signal repeater 150 can be used to amplify or increase the range of registration signal RS. Sensor 142*a* is configured to generate detection signal DS. Controller 108 is configured as a controller for monitoring system 140. Portable device 104*a* can also include motion sensor 152.

Registration signal RS allows sensor 142*a* to receive unique identifier IDa from portable device 104*a* so that it can be looked up in database 146, or some other hardware component defining a registry or directory of unique identifiers. In one embodiment, registration signal RS may be a Bluetooth signal or a BLE signal. Unique identifier Ida, which may comprise one or more number strings, letter strings, some other alphanumeric string, ASCII string, or the like, can be placed in database 146 by enrollment of portable device 104*a* with sensor 142A, such as through a user-initiated action. For example, an owner of system 140 can put sensor 142*a* or controller 108 into a learn mode and simultaneously put portable device 104*a* into a learn mode, wherein unique identifier IDa can be recorded in database 146. In other embodiments, unique identifier IDa can be recorded in database 146 through networks 112 and/or 106 if portable devices 104*a*-104*d* are separately registered with registration server 130. Subsequently, portable device 104*a* can be automatically recognized by system 140 as being an enrolled device. However, portable device 104*a* can be un-enrolled from database 146 and system 100 without the presence of and consent from portable device 104*a*. Controller 108 can be configured as a micro-computer system having one or more processors, memory devices, input devices, output devices, and the like.

If sensor 142*a* is able to match unique identifier IDa with a matching unique identifier in database 146, system 100 can be configured to give entity 148 immunity to system 100 without disabling the system and incurring vulnerability from unregistered users.

As illustrated, entity 148 is disposed outside of the range of detection signal DS. Thus, with either the strength of registration signal RS from portable device 104*a* alone, or with the aid of signal repeater 150, portable device 104*a* is able to establish immunity before sensor 142*a* can detect entity 148. Additionally, motion sensor 152 can be used to provide an early warning to sensor 142*a* that portable device 104*a* may be entering home 102.

Immunity can be granted to portable device 104*a* in a plurality of ways. System 140 will ignore entity 148 either by sensor 142*a* ignoring a detection signal (FIG. 5B), or by controller 108 ignoring a sensor signal from sensor 142*a* (FIGS. 6 and 7), or in some other way.

Figure 5A:
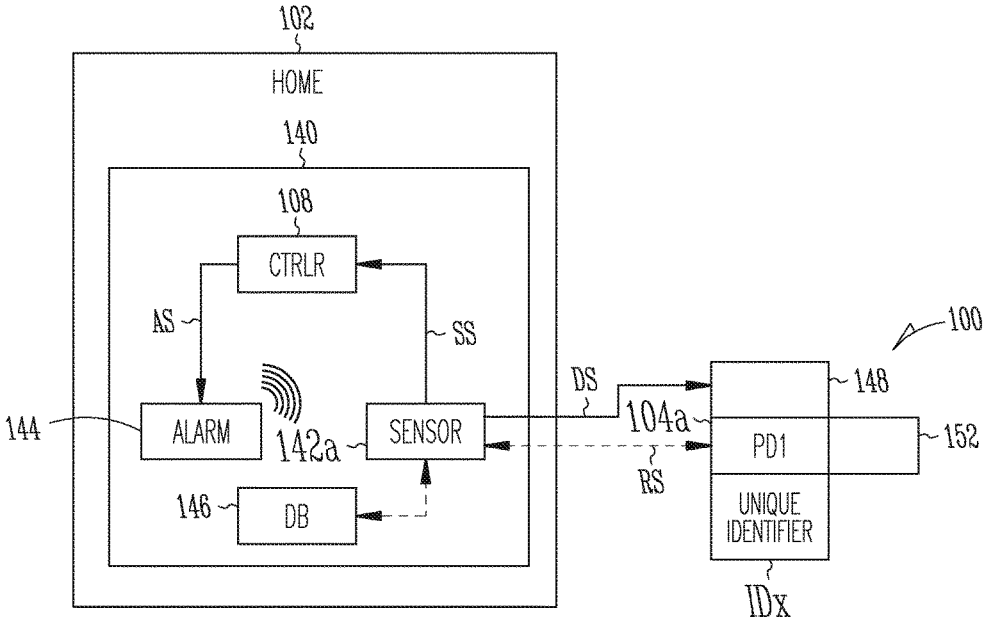
FIG. 5A illustrates a sensor of the monitoring system of FIG. 4 generating a sensor signal in response to detecting an entity not having a portable device with an immunity-granting unique identifier.

FIG. 5A illustrates sensor 142*a* generating sensor signal SS in response to detecting entity 148 having unregistered portable device 104*a* that is not granted immunity. FIG. 5A illustrates the example where portable device 104*a* does not have a unique identifier or unique identifier IDx is not cross-listed in database 146. In other embodiments, unique identifier IDx may be included in database 146, but portable device 104*a* might not be granted to immunity to sensor 142*a*, but rather is granted other immunity or access rights to system 100.

Sensor 142*a* looks for registration signal RS from portable device 104*a*. If none is detected, than the portable device is not granted any immunity and sensor 142*a* and system 100 can function normally to provide access, automation and security to home 102. If a registration signal RS is detected, portable device 104*a* and sensor 142*a* conduct initial communication using registration signal RS. In so doing, sensor 142*a* reads any information regarding unique identifiers contained in portable device 104*a*. In the illustrated embodiment of FIG. 5A, portable device 104*a* includes unique identifier IDx, which sensor 142*a* looks up in database 146 in an attempt to verify the registration of portable device 104*a*. Database 146 does not include registration of unique identifier IDx and sensor 142*a*, thus, does not grant immunity to portable device 104*a* for any alarms or conditions that may be triggered by entity 148. Verification of the unique identifier can, thus, comprises cross-referencing the unique identifier received from portable device 104*a* with a list of unique identifiers having immunity approval, e.g., unique identifier IDx can be compared to each unique identifier in database 146 to see of a match exists. If no match exists, when sensor 142*a* detects entity 148, sensor signal SS is sent to controller 108. Controller 108 reacts to sensor signal SS and generates alarm signal AS that is transmitted to alarm 144.

Activation of alarm 144 can result in a variety of actions. For example, alarm 144 may simply comprise an audible alarm within home 102. However, alarm 144 may also result in an automated phone call being placed to various authorities, people designated as administrators of system 100, or the owner(s) or resident(s) of home 102. Alarm signal AS may also comprise other various control signals used in an automation system, such as a signal used to adjust lighting brightness or adjust heating and cooling system set points, etc., such that alarm 144 may comprise some other action taken or not taken by system 100.

In one embodiment, sensor 142*a* comprises a presence sensor wherein the presence or location of a body within the range of detection signal DS causes the generation of sensor signal SS. In another embodiment, sensor 142*a* can be configured to detect the opening of a door or window by entity 148 such as by configuration as a proximity sensor. In other examples, sensor 142*a* can be configured to detect other conditions, such as a change in pressure produced by entity 148, a change in temperature produced by entity 148, a change in acceleration produced by entity 148, or the like.

Figure 5B:
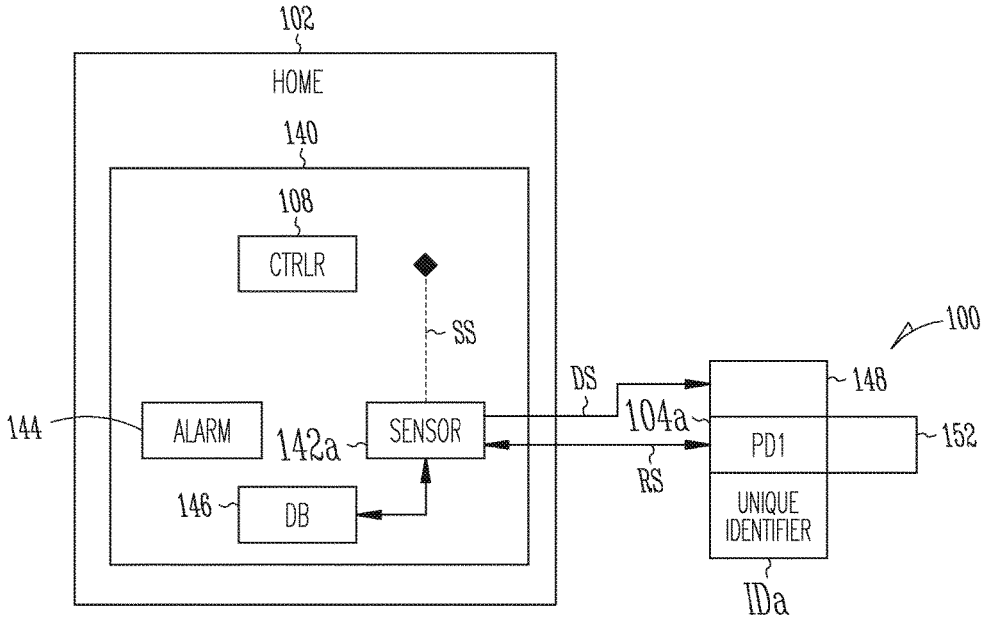
FIG. 5B illustrates a sensor of the monitoring system of FIG. 4 withholding generation of a sensor signal when detecting an entity having a portable device registered with an immunity-granting unique identifier.

FIG. 5B illustrates sensor 142*a* of monitoring system 140 withholding generation of sensor signal SS when detecting portable device 104*a* registered with immunity-granting unique identifier IDa.

Sensor 142*a* looks for registration signal RS from portable device 104*a*. Registration signal RS is detected, and portable device 104*a* and sensor 142*a* conduct initial communication using registration signal RS. In so doing, sensor 142*a* reads any information regarding unique identifiers contained in portable device 104*a*. In the illustrated embodiment of FIG. 5B, portable device 104*a* includes unique identifier IDa, which sensor 142*a* looks up in database 146 in order to verify the registration of portable device 104*a*. Database 146 includes registration of unique identifier IDa, which results in sensor 142*a* granting immunity to portable device 104*a* for any alarms or conditions that may be triggered by entity 148 with sensor 142*a*.

Once registration is complete, if sensor 142*a* detects entity 148, sensor signal SS will not be sent to controller 108. As such, in one embodiment, granting of immunity by ignoring a detected condition by monitoring system 140 can comprise withholding of an alarm/action signal. In another embodiment, sensor 142*a* can be configured to directly trigger alarm 144 without intervention from controller 108 and, in which case, sensor 142*a* can be configured to withhold activation of alarm 144 if registration of portable device 104*a* is verified with database 146. Portable device 104*a* can be configured to periodically transmit registration signal RS in order to save energy, e.g. battery life. If so, sensor 142*a* can be configured with a delay in generating sensor signal SS after detection signal DS detects entity 148 to allow for the registration process to occur. Thus, the delay can be greater than or equal to the amount of time between periodic transmissions from portable device 104*a* plus any time needed to complete the registration process. Additionally, controller 108 can be programmed to recognize that portable device 104*a* has entered home 102 and has not yet left home 102 so that controller 108 or sensor 142*a* can be programmed to ignore any motion detected in home 102 by sensor 142*a* until confirmation is obtained that portable device 104*a* has left home 102. In additional embodiments, portable device 104*a* can include motion sensor 152. Motion sensor 152 can comprise an accelerometer or a gyroscope that can generate a motion signal when portable device 104*a* moves or is subjected to motion. The motion signal can be provided to sensor 142*a* via registration signal RS. The motion signal can be transmitted to sensor 142*a* prior to portable device 104*a* entering the range of detection signal DS either by the strength of signal DS or through the use of signal repeater 150. As such, controller 108 can be provided with an advance warning that portable device 104*a* is in motion and may be entering home 102. Controller 108 can also be provide with the motion signal while portable device 104*a* is within home 102 to let controller know that portable device 104*a* is potentially nearing various sensors or has not yet left home 102. Additionally, while portable device 104*a* is within home 102, the motion signal, or lack thereof, can be used to save power within monitoring system 140, such as by allowing various sensors to power down if a motion signal is not detected.

In one embodiment, controller 108 is unaware of the presence of entity 148 and portable device 104*a*. However, sensor 142*a* may record and retain immunity data (time, date, location, etc.) that can be retrieved at a later time utilizing a separate transaction with sensor 142*a*. As such, ignoring a detected condition by monitoring system 140 can comprise logging event data without generating an alarm/ action signal. In other embodiments, as is described below with reference to FIG. 6, sensor 142*a* can transmit immunity data to controller 108. In yet another embodiment, as is described below with reference to FIG. 7, controller 108 may independently record data regarding the immunity and presence of portable device 104*a* and entity 148.

It is noted that, although portable device 104*a* is granted immunity, portable device 104*a* itself may or may not result in detection signal DS causing sensor 142*a* to produce sensor signal SS due to the relatively small footprint, e.g. size and weight, of portable device 104*a*. As such, the immunity generated by portable device 104*a* can be extended to entity 148, which is disposed in close proximity to portable device 104*a*. However, only sensor 142*a* is disabled within system 100 and any other sensors, e.g. sensor 142*b* located in another location in home 102, remain enabled and are actively providing feedback to controller 108, unless additional immunity privileges have been granted from that particular sensor. Thus, sensor 142*b* may still detect a condition triggered by entity 148 and cause a subsequent alarm or automated action to be taken.

Figure 6:
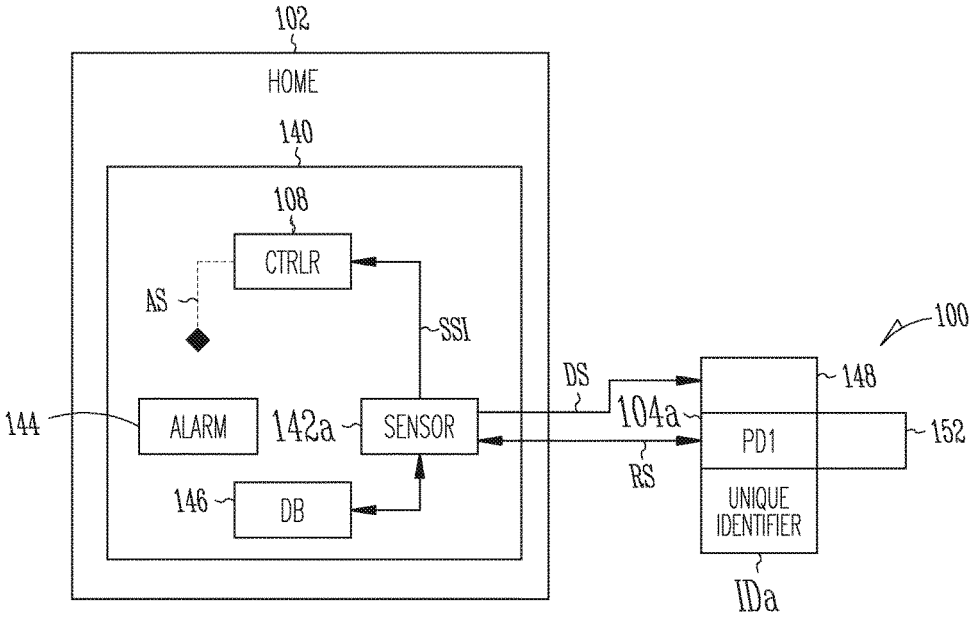
FIG. 6 illustrates a sensor of the monitoring system of FIG. 4 generating a sensor signal embedded with immunity information when detecting an entity having a portable device registered with an immunity-granting unique identifier.

FIG. 6 illustrates sensor 142*a* of monitoring system 140 generating sensor signal SSI embedded with immunity information when detecting portable device 104*a* registered with immunity-granting unique identifier IDa.

Sensor 142*a* looks for registration signal RS from portable device 104*a*. Registration signal RS is detected, and portable device 104*a* and sensor 142*a* conduct initial communication using registration signal RS. In so doing, sensor 142*a* reads any information regarding unique identifiers contained in portable device 104*a* in order to verify the registration of portable device 104*a*. In the illustrated embodiment of FIG. 6, portable device 104*a* includes unique identifier IDa, which sensor 142*a* looks up in database 146. Database 146 includes registration of unique identifier IDa and sensor 142*a*, thus, grants immunity to portable device 104*a* for any alarms or conditions that may be triggered by entity 148. Thus, if sensor 142*a* detects entity 148, sensor signal SSI will be sent to controller 108. Sensor signal SSI includes information indicating that detection signal DS was triggered while portable device 104*a* was registered with sensor 142*a*. Thus, SSI may include a specific instruction to ignore sensor signal SS and not generate alarm signal AS. SSI may additionally or alternatively include an immunity instruction to override generation of alarm signal AS. Furthermore, SSI may include log information regarding the time, date and location that portable device 104*a* entered into system 100 or home 102.

Figure 7:
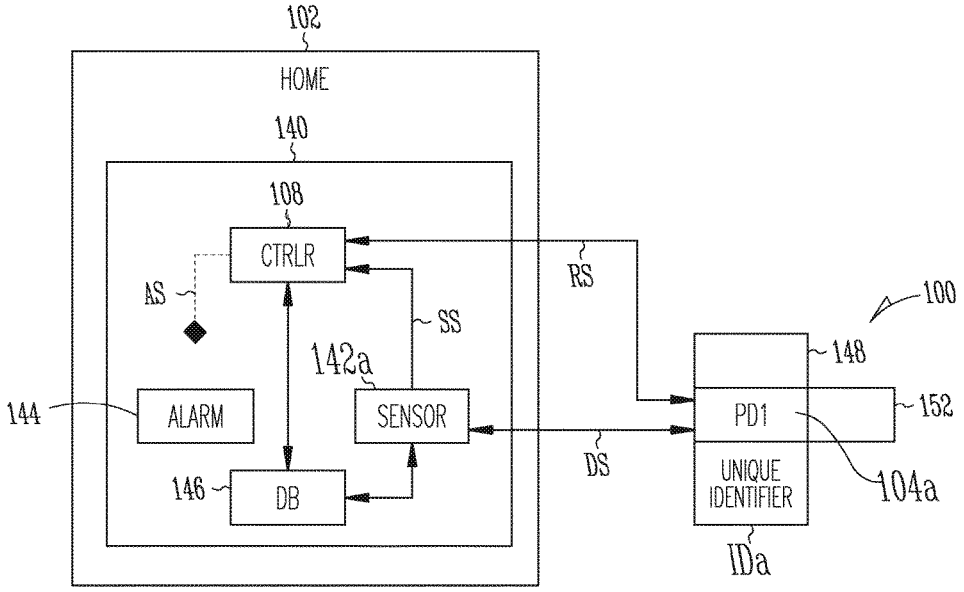
FIG. 7 illustrates a sensor of the monitoring system of FIG. 4 generating a sensor signal when detecting an entity having a portable device with an immunity-granting unique identifier separately registered with a controller of the monitoring system.

FIG. 7 illustrates sensor 142*a* of monitoring system 100 generating sensor signal SS when detecting portable device 104*a*, which has been separately registered with monitoring system 140. In the illustrated embodiment, portable device 104*a* is registered with controller 108.

Controller 108 looks for registration signal RS from portable device 104*a*. Registration signal RS is detected, and portable device 104*a* and controller 108 conduct initial communication using registration signal RS. In so doing, controller 108 reads any information regarding unique identifiers contained in portable device 104*a* in order to verify the registration of portable device 104*a*. In the illustrated embodiment of FIG. 7, portable device 104*a* includes unique identifier IDa, which controller 108 looks up in database 146. Database 146 includes registration of unique identifier IDa and controller 108, thus grants immunity to portable device 104*a* for any alarms or conditions that may be triggered by entity 148. Thus, if sensor 142*a* detects entity 148, sensor signal SS is sent to controller 108, but controller 108 will recognize that sensor signal SS was generated by immune portable device 104*a*, and alarm signal AS will not be generated. Controller 108 may communicate with portable device 104*a* directly, such as by utilizing BLE, or through various networks including local network 106 and network 112 (FIG. 1). Controller 108 may also receive early warning information from motion sensor 152 via registration signal RS to alert controller 108 to the anticipated presence of portable device 104*a* or for power saving functionality, as described above.

The various embodiments described with reference to FIGS. 5A, 5B, 6 and 7 may be implemented separately or in any combination with each other.

The systems and methods described herein are useful in many situations. In particular, portable devices with unique identifiers can be associated with pets, such as by attachment to a collar, in order to allow the pet immunity and free range of a home without having to disable an entire security system. Pet immunity is also useful in, for example, saving energy by preventing activation of lighting in home automation systems. Security personnel, such as guards and guard dogs, can be provided with immunity in order to prevent unintended activation of security systems while making rounds. Caregivers in assisted living facilities can be granted immunity to security systems designed to prevent patients from wandering off-premises or into unauthorized areas. Additionally, homeowners and residents, or other owners of security systems, can be granted immunity in order to avoid the hassle of having to repeatedly disarm and arm their security system when home and away, for pets, or when coming and going during unscheduled times.

The systems and methods described herein allow the aforementioned systems (security systems, monitoring systems, surveillance systems, access control systems, automation systems, emergency response systems, and control systems for use in home, commercial and government environments) to discriminate between occupants of a secured or monitored area. The occupants given a portable device with a unique identifier can be granted full immunity (wherein free movement throughout the secured or monitored area is permitted), partial immunity (wherein only certain functions or operations of the system are muted to the occupant), or not be granted any immunity (wherein the occupant is visible to all functions and operations of the system). Additionally, the systems will still be actively armed such that other sensor not put into an immunity state will continue to guard against occupants without a registered portable device.

The systems and methods described herein help in reducing false alarms, either by pets, security personnel, or authorized occupants, by better differentiating between real alarms and false alarms, thereby reducing costs to owners and law enforcement agencies.

Various Notes and Examples

Example 1 can include subject matter such as system including: a portable device configured to communicate a unique identifier with a registration signal; and a monitoring system comprising: a database including the unique identifier; a sensor configured to detect a condition; and a controller configured to receive a detection signal from the sensor when the condition is detected; wherein the monitoring system grants immunity from the sensor to the portable device when the registration signal is received by the monitoring system.

Example 2 can include, or can optionally be combined with, the subject matter of Example 1 to optionally include a monitoring system that is configured to grant immunity by determining if the unique identifier of the sensor matches an entry in the database, and ignoring a detected condition by the sensor if the unique identifier of the portable device is verified in the database.

Example 3 can include, or can optionally be combined with, the subject matter of one or any combination of Examples 1 and 2 to optionally include a monitoring system that receives the registration signal via the sensor.

Example 4 can include, or can optionally be combined with, the subject matter of one or any combination of Examples 1-3 to optionally include a sensor that is configured to identify the portable device using the unique identifier and not generate a sensor signal if the portable device is within a range of the sensor.

Example 5 can include, or can optionally be combined with, the subject matter of one or any combination of Examples 1-4 to optionally include a sensor that is configured to identify the portable device using the unique identifier and generate an immunity signal for transmission to the controller, and the controller does not generate an alarm signal.

Example 6 can include, or can optionally be combined with, the subject matter of one or any combination of Examples 1-5 to optionally include a sensor that is configured to communicate with the database.

Example 7 can include, or can optionally be combined with, the subject matter of one or any combination of Examples 1-6 to optionally include a monitoring system that receives the registration signal via the controller.

Example 8 can include, or can optionally be combined with, the subject matter of one or any combination of Examples 1-7 to optionally include a controller that is configured to identify the portable device using the unique identifier and not generate an alarm signal if the portable device is within a range of the sensor.

Example 9 can include, or can optionally be combined with, the subject matter of one or any combination of Examples 1-8 to optionally include a controller that is configured to communicate with the database.

Example 10 can include, or can optionally be combined with, the subject matter of one or any combination of Examples 1-9 to optionally include a range of the registration signal that is greater than a detection range of the sensor.

Example 11 can include, or can optionally be combined with, the subject matter of one or any combination of Examples 1-10, to optionally include a registration signal repeater to convey the registration signal from the portable device to the sensor.

Example 12 can include, or can optionally be combined with, the subject matter of one or any combination of Examples 1-11 to optionally include a portable device that includes a tamper sensor configured to provide an indication in the registration signal that the portable device has been compromised.

Example 13 can include, or can optionally be combined with, the subject matter of one or any combination of Examples 1-12 to optionally include a portable device having a motion sensor.

Example 14 can include subject matter such as a method for granting immunity to an entity in a monitoring system, the method comprising: registering a unique identifier associated with a portable device with a monitoring system; detecting the portable device by a sensor; and withholding activation of an alarm based on registration of the portable device.

Example 15 can include, or can optionally be combined with, the subject matter of Example 14 to optionally include activation of the alarm that is conducted by a controller for the monitoring system.

Example 16 can include, or can optionally be combined with, the subject matter of one or any combination of Examples 14 and 15 to optionally include registering of the unique identifier with the monitoring system that comprises: storing the unique identifier in a database accessible to the sensor; and establishing a registration communication between the sensor and the portable device.

Example 17 can include, or can optionally be combined with, the subject matter of one or any combination of Examples 14-16 to optionally include registering of the unique identifier with the monitoring system that comprises: storing the unique identifier in a database accessible to a controller of the monitoring system; and establishing a registration communication between the controller and the portable device.

Example 18 can include, or can optionally be combined with, the subject matter of one or any combination of Examples 14-17 to optionally include withholding activation of the alarm based on registration of the portable device that comprises: verifying registration of the portable device by a the sensor; and withholding generation of a sensor signal by the sensor after detecting the portable device.

Example 19 can include, or can optionally be combined with; the subject matter of one or any combination of Examples 14-18 to optionally include withholding activation of the alarm based on registration of the portable device that comprises: verifying registration of the portable device by the sensor; transmitting a sensor signal from the sensor to a controller after detecting the portable device, the sensor signal including immunity information; determining by the controller that the sensor signal was generated by a portable device associated with the verified registration; and withholding generation of an alarm signal.

Example 20 can include, or can optionally be combined with, the subject matter of one or any combination of Examples 14-19 to optionally include withholding activation of the alarm based on registration of the portable device that comprises: verifying registration of the portable device by a controller; transmitting a sensor signal from the sensor to the controller after detecting the portable device; determining by the controller that the sensor signal was generated by an entity associated with the verified registration; and withholding generation of an alarm signal.

Example 21 can include, or can optionally be combined with, the subject matter of one or any combination of Examples 14-20 to optionally include extending a range of a registration signal from the portable device to beyond a detection range of the sensor using a repeater.

Example 22 can include, or can optionally be combined with, the subject matter of one or any combination of Examples 14-21 to optionally include sensing a tamper condition of the sensor; and transmitting a tamper signal from the sensor to the monitoring system.

Example 23 can include, or can optionally be combined with, the subject matter of one or any combination of Examples 14-22 to optionally include detecting of the portable device that includes detection of an entity associated with the portable device.

Example 24 can include, or can optionally be combined with, the subject matter of one or any combination of Examples 14-23 to optionally include detecting motion of the portable device with a motion sensor in the portable device, and transmitting a motion signal from the portable device to the monitoring system before detecting the portable device by the sensor.

Example 25 can include subject matter such as a monitoring system comprising: a database including a unique identifier of a first portable device configured to communicate with the monitoring system using a registration signal; and a plurality of sensors each configured to detect a condition; wherein the monitoring system is configured to grant immunity from at least one of the plurality of sensors to the first portable device when the monitoring system verifies a unique identifier transmitted by the registration signal with the database.

Example 26 can include, or can optionally be combined with, the subject matter of Example 25 to optionally include an alarm configured to be activated by the monitoring system when the condition is detected and immunity is not granted.

Example 27 can include, or can optionally be combined with, the subject matter of one or any combination of Examples 25 and 26 to optionally include a sensor that is configured to activate the alarm.

Example 28 can include, or can optionally be combined with, the subject matter of one or any combination of Examples 25-27 to optionally include a controller configured to communicate with the sensor and activate the alarm.

Example 29 can include, or can optionally be combined with, the subject matter of one or any combination of Examples 25-28 to optionally include a first portable device that is not granted immunity to one or more of the plurality of sensors when the monitoring system verifies a unique identifier transmitted by the registration signal with the database.

Example 30 can include, or can optionally be combined with, the subject matter of one or any combination of Examples 25-29 to optionally include a second portable device granted immunity different than the first portable device when the monitoring system verifies a unique identifier of the second portable device transmitted by a registration signal of the second portable device with the database.

Each of these non-limiting examples can stand on its own, or can be combined in any permutation or combination with any one or more of the other examples.

The above detailed description includes references to the accompanying drawings and figures, which form a part of the detailed description. The drawings and figures show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed. Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A sensor for use with a monitoring system, the sensor comprising:

means for generating a detection signal;

means for receiving a registration signal including a unique identifier for a device;

means for accessing a database including a registry of unique identifiers for devices approved for operating with immunity from the monitoring system; and means for generating a sensor signal to cause activation of an alarm;

wherein a range of the registration signal is greater than a range of the detection signal.

2. The sensor of claim 1, wherein the means for generating a detection signal is selected from the group consisting of: an occupancy sensor, a proximity sensor, a contact sensor a temperature sensor and a pressure sensor.

3. The sensor of claim 1, wherein the means for receiving a registration signal including a unique identifier for a device is selected from the group consisting of: a Z-Wave data reader, a Bluetooth data reader, a Bluetooth Low Energy data reader, a near field communication data reader, a Zigbee data reader and a WiFi data reader.

4. The sensor of claim 1, wherein the means for accessing a database including a registry of unique identifiers for devices approved for operating with immunity from the monitoring system is selected from the group consisting of: a tangible storage medium located within the sensor, the tangible storage medium having stored therein programmed data comprising the database, and a tangible storage medium located within the monitoring system, the tangible storage medium having stored therein programmed data comprising the database.

5. The sensor of claim 1, wherein the means for generating a sensor signal to cause activation of an alarm is selected from the group consisting of: a network interface device for directly communicating the sensor signal informing a controller of the monitoring system to activate the alarm, and a network interface device for communicating the sensor signal and a unique identifier to the controller of the monitoring system so the alarm can be indirectly activated by the controller of the monitoring system.

6. The sensor of claim 1, wherein the sensor is configured to simultaneously scan for the registration signal and generate the detection signal.

7. The sensor of claim 6, wherein the sensor is configured to delay generating the sensor signal after the detection signal senses a condition to allow time for the unique identifier for the device of the registration signal to be cross-referenced in the database.

8. The sensor of claim 1, further comprising a signal repeater to extend a range of the registration signal beyond a range of the detection signal.

9. The sensor of claim 1, wherein the sensor is configured to not transmit the sensor signal if the unique identifier for the device of the registration signal is found in the database.

10. An immunity-granting sensor device system for a monitoring system, the sensor device system comprising:

a detection sensor configured to generate a detection signal for sensing a condition;

a data reader configured to read a unique identifier from a registration signal of a tag;

a network interface configured to communicate a sensor signal to the monitoring system;

a look-up module configured to cross-reference the unique identifier in a database containing a plurality of unique identifiers granted immunity from the detection sensor system; and a tangible storage medium in the sensor device system, the tangible storage medium including the database;

wherein the sensor device system is configured generate the sensor signal to activate an alarm if the detection signal is generated and the unique identifier is not located in the database.

11. The sensor device system of claim 10, further comprising a signal repeater configured to extend a range over which the data reader can read a unique identifier from the tag to beyond a range of the detection signal.

12. The sensor device system of claim 10, wherein the sensor signal includes an instruction for generating an alarm.

13. The sensor device system of claim 10, wherein the sensor signal includes the unique identifier.

14. The sensor device system of claim 10, further comprising a controller for the monitoring system that is configured to receive the sensor signal and generate the alarm.

15. The immunity-granting sensor device system of claim 14, wherein the controller comprises an additional tangible storage medium including a copy of the database.

16. The sensor device system of claim 10, further comprising a portable device comprising:

a tangible storage medium including the unique identifier;

a motion sensor for generating a motion signal when the portable device moves; and a data reader for transmitting the registration signal to include at least one of the unique identifier and the motion signal.

17. The immunity-granting sensor device system of claim 10, wherein the detection sensor, the data reader, the network interface, the look-up module and the tangible storage medium comprise a single apparatus.

18. A method of operating an immunity-granting sensor for a monitoring system, the method comprising:

generating a detection signal to sense a condition with a sensor device located remotely from a monitoring system controller;

reading a registration signal from a portable device located remotely from the sensor device, the registration signal including a unique identifier;

cross-referencing the unique identifier with a database located in a tangible storage medium including a plurality of unique identifiers associated with portable devices granted immunity from the sensor device; and generating a sensor signal containing at least one of the unique identifier or instructions for generating an alarm signal when the condition is sensed;

wherein the unique identifier is cross-referenced with the database after the condition is sensed and before the sensor signal is generated.

19. The method of claim 18, further comprising extending a range over which the registration signal can be read from the portable device beyond a range of the detection signal.

20. The method of claim 18; wherein:

the tangible storage medium is located within the immunity granting sensor; and generating the sensor signal comprises generating a sensor signal containing instructions for the monitoring system controller of the monitoring system to generate the alarm signal.

21. The method of claim 20, further comprising not generating a sensor signal containing either the unique identifier or instructions for generating an alarm signal when the condition is sensed and the unique identifier is listed in the database.

22. The method of claim 18, wherein:

the tangible storage medium is located within the immunity granting sensor; and generating the sensor signal comprises generating a sensor signal containing the unique identifier so the monitoring system controller can cross-reference the unique identifier in the database and generate the alarm signal.

23. The method of claim 18, wherein:

the tangible storage medium is located within the immunity granting sensor; and generating the sensor signal comprises generating a sensor signal containing the unique identifier and instructions for the monitoring system controller of the monitoring system to generate the alarm signal.

* * * * *